US011871850B1

(12) United States Patent
Fang

(10) Patent No.: US 11,871,850 B1
(45) Date of Patent: Jan. 16, 2024

(54) BED RAIL WITH TABLE

(71) Applicant: Xicheng Fang, Zhejiang (CN)

(72) Inventor: Xicheng Fang, Zhejiang (CN)

( * ) Notice: Subject to any disclaimer, the term of this patent is extended or adjusted under 35 U.S.C. 154(b) by 0 days.

(21) Appl. No.: 18/354,827

(22) Filed: Jul. 19, 2023

(51) Int. Cl.
*A47C 21/08* (2006.01)
*A47B 23/02* (2006.01)

(52) U.S. Cl.
CPC ..... *A47C 21/08* (2013.01); *A47B 23/025* (2013.01); *A47B 23/02* (2013.01)

(58) Field of Classification Search
CPC ..... A47C 21/08; A47C 21/00; A47B 23/025; A47B 23/02; A47B 23/00; A61G 7/0507; A61G 7/0508; A61G 7/0509
USPC ..... 5/426, 428, 430, 425, 503.1, 507.1, 658, 5/659
See application file for complete search history.

(56) References Cited

U.S. PATENT DOCUMENTS 866,522 A * 9/1907 Scanlon ..... A47B 23/02 5/95
1,267,046 A * 5/1918 Beaird ..... A47B 5/04 5/507.1
1,312,274 A * 8/1919 Sculthorp ..... A47C 3/26 248/278.1
1,347,271 A * 7/1920 Hartman ..... A47B 23/02 5/507.1
1,862,237 A * 6/1932 Pepler ..... A47B 23/02 211/119.006
2,558,366 A * 6/1951 Madlena ..... A47B 23/02 5/507.1
2,703,265 A * 3/1955 Wolfe ..... A47B 23/02 5/503.1
3,543,312 A * 12/1970 Pofferi ..... A47B 23/02 108/49
4,357,881 A * 11/1982 De Long ..... A47B 23/02 211/88.01
6,253,399 B1 * 7/2001 Wagner ..... A47B 23/025 5/503.1
9,345,320 B2 * 5/2016 Calderone ..... A47B 23/025
9,826,827 B2 * 11/2017 Calderone ..... A47B 23/025
9,867,459 B2 * 1/2018 Calderone ..... A47B 23/00
2015/0296977 A1 * 10/2015 Calderone ..... A47B 23/025 5/2.1
2016/0000222 A1 * 1/2016 Calderone ..... A47C 7/70 108/42
2016/0058177 A1 * 3/2016 Calderone ..... A47B 3/002 5/507.1

* cited by examiner

*Primary Examiner* — Robert G Santos
(74) *Attorney, Agent, or Firm* — Daniel M. Cohn; Howard M. Cohn

(57) ABSTRACT

The present invention provides a bed rail with table, which comprises a guardrail and a table board, wherein the guardrail consists of an outer frame with an inner extension arm and a fixed end which can be attached to a bed body; and the table board comprises a relatively flat table board surface and a rotation restricting part which is pivotally attached to the outer frame to rotate between a first position and a second position around a first axis.

9 Claims, 21 Drawing Sheets

BED RAIL WITH TABLE

TECHNICAL FIELD

The present invention relates to the technical field of bedside guardrails, in particular to a bed rail with table.

BACKGROUND

In nursing scenes such as hospitals, guardrails are often set at the bedside to confine people who need nursing to the bed, so as to avoid secondary injuries caused by falling out of bed. However, most of the traditional bedside guardrails are integrated with the bed, and when guardrails are not needed, guardrails will become a great obstacle. For example, when changing sheets or mattresses, guardrails will increase the difficulty of replacement.

In the prior art, a reversible guardrail is also proposed, which can accommodate the guardrail without the block function provided by the guardrail, for example, U.S. Pat. Nos. 9,756,954, 8,104,118 and 7,784,125.

However, the guardrail disclosed above only has the function of protecting the block. In practical process, for example, when patients need to have meals in bed, they need to have meals with the help of the dining table. In order to further facilitate the nursing work, many solutions have been proposed in the prior art, such as U.S. Pat. No. 9,492,340 and U.S. Pat. No. US1,347,271A. However, the technical solutions disclosed above are cumbersome in practical use, complicated in structure and high in quality.

Although many bedside guardrails convenient for nursing work have been put forward in the prior art, users always hope to provide updated bedside guardrails, which can facilitate nursing work without affecting nursing work.

Based on the above problems, it is necessary to put forward a brand-new bedside guardrail, which has a good protection and blocking function, can confine patients to the bed, and can be conveniently and quickly accommodated by nursing workers when the blocking function of the guardrail is not needed. In addition, the guardrail also has a dining table function, which can quickly provide a support platform when patients need to have meals in bed. At the same time, the support platform has a simple structure and a low failure rate, which is further convenient for nursing work and patients to use.

SUMMARY

The present invention provides a bed rail with table, which includes a guardrail and a table board, wherein the guardrail consists of an outer frame with inner extension arms and a fixed end which can be attached to a bed body, the outer frame defines a basically flat blocking plane, and the inner extension arms extend from the outer frame and extend on the blocking plane;

the table board includes a relatively flat table board surface and a rotation restricting part pivotally attached to the outer frame to rotate between a first position and a second position around a first axis, wherein the rotation restricting part extends from the table board in a direction substantially opposite to the supporting direction of the table board surface;

when the table board pivots around the first axis X and is in the first position, the rotation restricting part ends on the blocking plane, and the table board surface remains basically parallel to the ground; when the table board pivots around the first axis and is in the second position, the supporting direction of the table board surface faces away from the bed body.

The present invention further provides a bed rail with table, which a guardrail and a table board, wherein, the guardrail consists of an outer frame with an inner extension arm and a fixed end that can be attached to a bed body, wherein the outer frame defines a substantially flat blocking plane, and the inner extension arm extends from the outer frame and extends on the blocking plane;

the table board comprises a relatively flat table board surface and a rotation restricting part pivotally attached to the outer frame to rotate between a first position and a second position around a second axis, wherein the rotation restricting part extends from the table board in a direction substantially opposite to a supporting direction of the table board surface;

when the table board pivots around the second axis and is in the first position, the rotation restricting part ends on the blocking plane, and the table board surface remains basically parallel to the ground; when the table board pivots around the second axis and is in the second position, the supporting direction of the table board surface faces away from the bed body;

the bedside guardrail further includes a multi-axis rotating device, wherein one end of the multi-axis rotating device is rotatably connected with one end of the outer frame, and the other end is detachably attached to the table board, and the table board rotates between the first position and the second position around the second axis through the multi-axis rotating device.

BRIEF DESCRIPTION OF DRAWINGS

In order to explain the technical solution of this application more clearly, the drawings needed in the implementation will be briefly introduced below. Obviously, the drawings described below are only some implementations of this application. For those skilled in the art, other drawings can be obtained according to these drawings without creative work.

In the figures.

100, Bed body; 110, Mattress; 200, Guardrail; 210, Inner extension arm; 220, Outer frame; 221, Horizontal pipe; 222, Vertical pipe; 223, Rounded corner; 230, Fixed end; 231, Bending part; 232, Long straight section; 233, Retaining device; 234, Upper section; 235, Lower section; 240, Rotating mechanism; 241, Rotating shaft; 242, Fixing pin; 300, Table board; 310, Table board surface; 320, Rotation restricting part; 330, Retaining lip; 340, Cup holder; 400, Pivot member; 410, Central opening; 420, Fixing device; 430, Threaded hole; 500, Multi-axis rotating device; X, First axis; Y, Second axis.

DESCRIPTION OF EMBODIMENTS

In the following, the technical solution in the embodiment of the application will be clearly and completely described with reference to the drawings in the embodiment of the application. Obviously, the described embodiment is only a part of the embodiment of the application, but not the whole embodiment. Based on the embodiments in this application, all other embodiments obtained by ordinary technicians in this field without creative labor belong to the protection scope of this application.

Reference to "an example" or "an embodiment" herein means that a particular feature, structure or characteristic described in connection with an embodiment or an embodiment can be included in at least one embodiment of this application. The appearance of this phrase in various places in the specification does not necessarily refer to the same embodiment, nor is it an independent or alternative embodiment mutually exclusive with other embodiments. It is understood explicitly and implicitly by those skilled in the art that the embodiments described herein can be combined with other embodiments.

In this specification, for the sake of convenience, words and expressions indicating orientation or positional relationship such as "middle", "upper", "lower", "front", "rear", "vertical", "horizontal", "top", "inner" and "outer" are used to illustrate the positional relationship of constituent elements with reference to the attached drawings, only for the convenience of description. The positional relationship of the constituent elements is appropriately changed according to the direction of the described constituent elements. Therefore, it is not limited to the words and expressions described in the specification, and can be replaced appropriately according to the situation.

Figure 1:
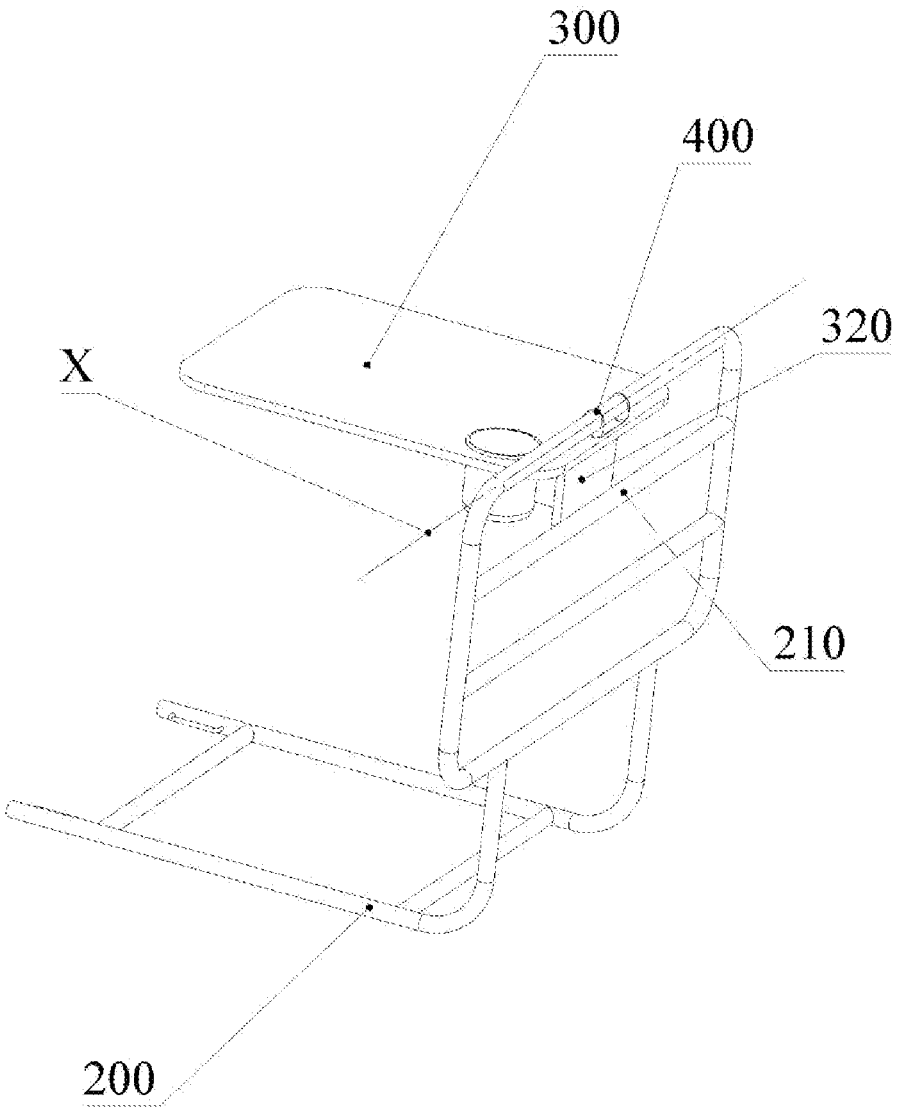
FIG. 1 is a schematic view of a table board in a first position.
Figure 2:
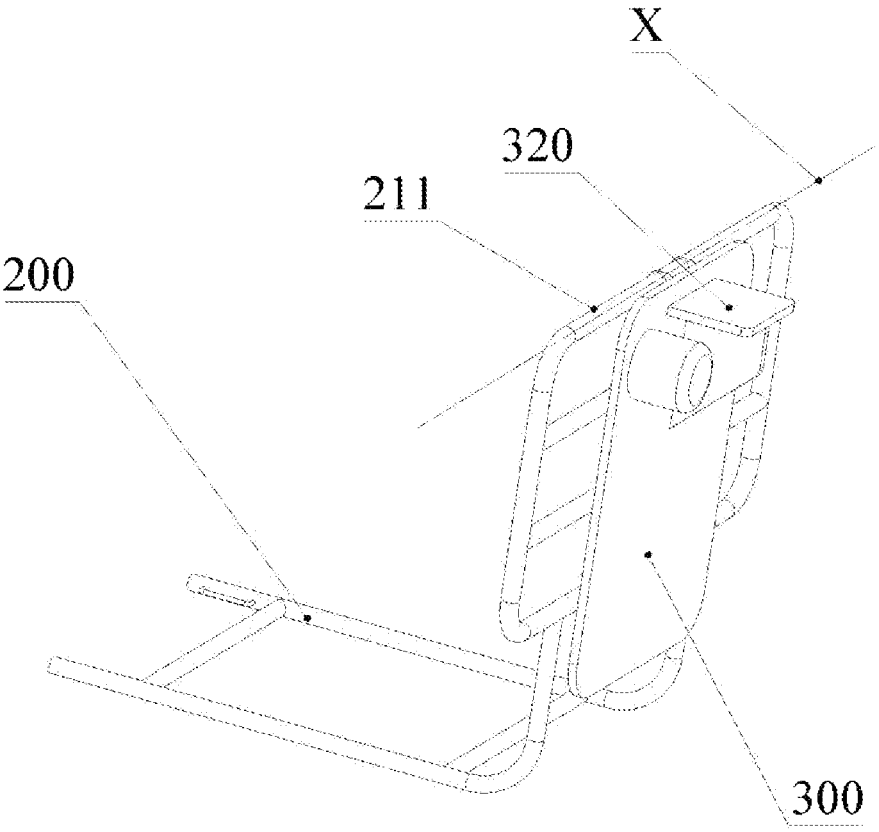
FIG. 2 is a schematic view of the table board in a second position.

As shown in FIGS. 1 and 2, the present invention provides a bed rail with table, including a guardrail 200 and a table board 300.

Figure 4:
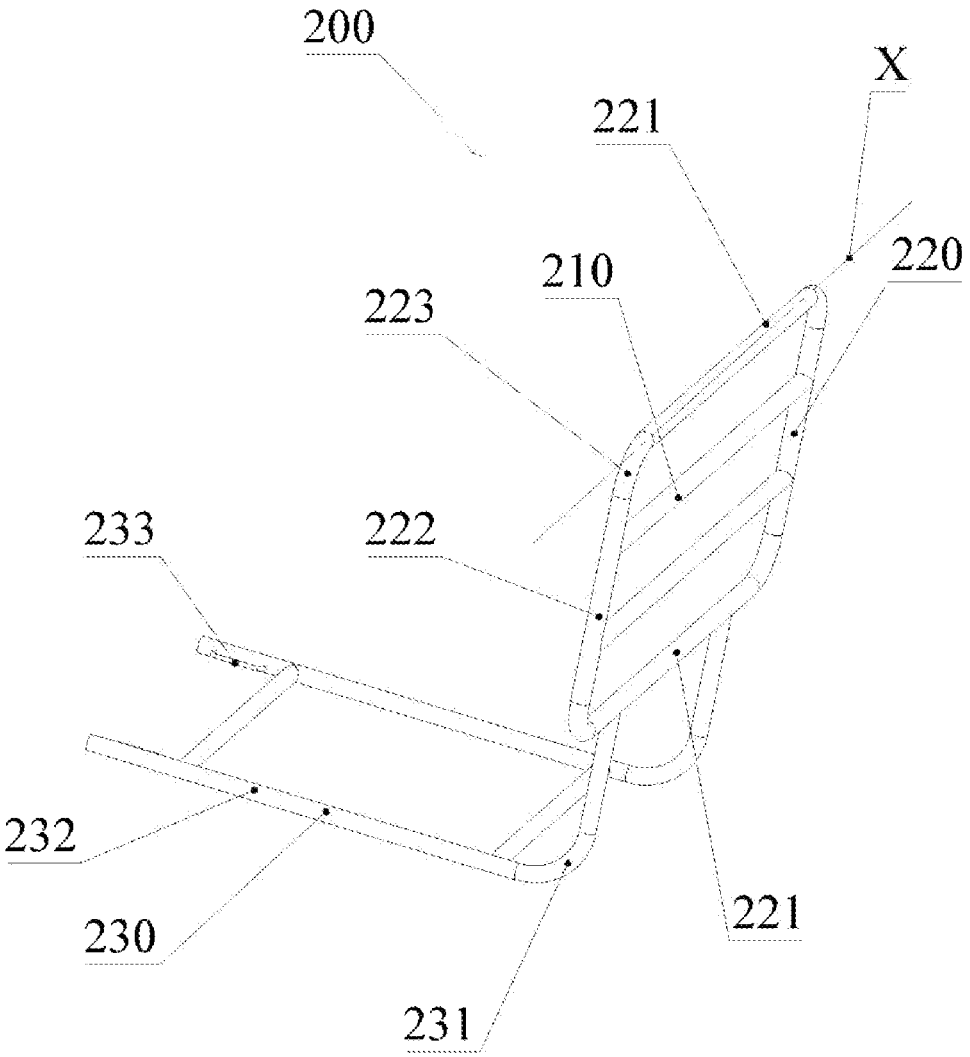
FIG. 4 is a schematic diagram of a guardrail.

As shown in FIG. 4, the guardrail 200 is composed of an outer frame 220 with an inner extension arm 210 and a fixed end 230 that can be attached to the bed 100, wherein the outer frame 220 is configured to form a block for patients on the bed 100, which defines a substantially flat blocking plane, and the inner extension arm 210 extends from the outer frame 220 and extends on the blocking plane.

Specifically, the outer frame 220 is generally rectangular, which is formed by connecting two parallel horizontal pipes 221 and two parallel vertical pipes 222 end to end, wherein the horizontal pipes 221 and the vertical pipes 222 are configured to have cylindrical surfaces, so that users can grasp them more easily. In some embodiments (not shown in the figure), in order to further facilitate users' grasping, the outer surfaces of the horizontal pipes 221 and the vertical pipes 222 are also provided with anti-skid lines or anti-skid bumps, in order to further increase the friction between the user and the outer frame 220 of the guardrail 200 when grasping, and reduce the risk of the user's palm falling off the outer frame 220 when grasping.

In this embodiment, the outer frame 220 is integrally formed, and the joint of the horizontal pipe 221 and the vertical pipe 222 is configured with a rounded corner 223, which can effectively avoid the danger brought by the right angle to the user, and the shape of the rounded corner 223 is also easier for the user to grasp. In some embodiments, the outer frame 220 can also be formed by assembly, for example, the horizontal pipe 221 and the vertical pipe 222 are assembled into a substantially rectangular outer frame 220 by using fillet connectors (not shown in the figure).

Figure 5:
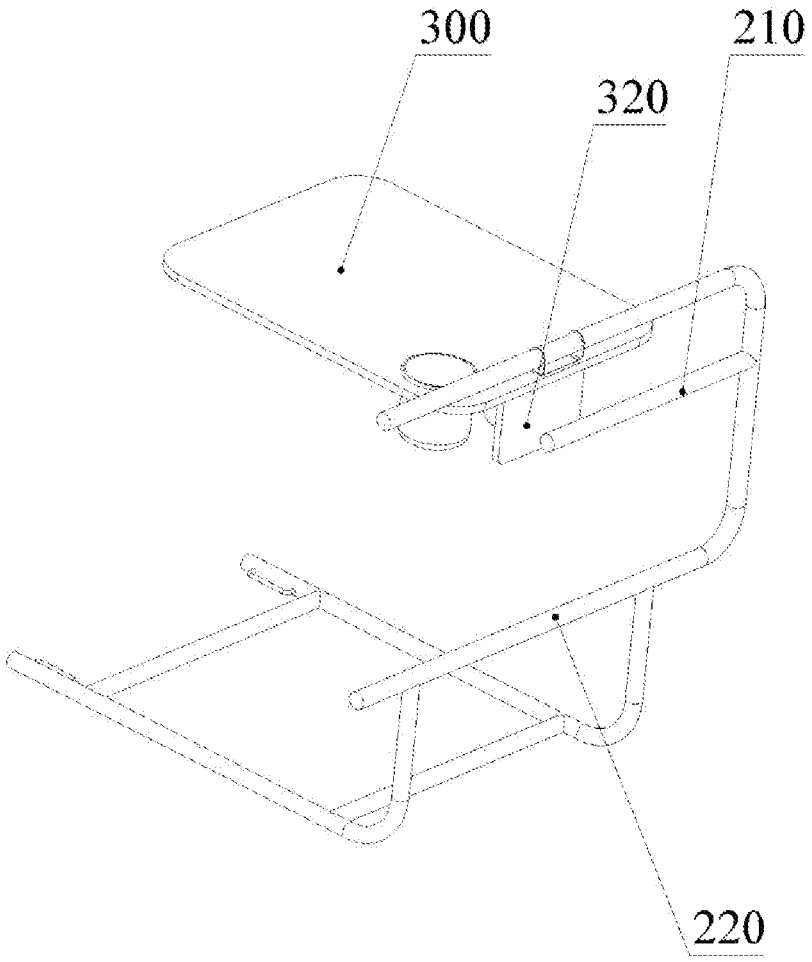
FIG. 5 is another schematic view of the guardrail.

In other embodiments, the outer frame 220 is not limited to the rectangular outer contour. In order to further reduce the manufacturing cost or provide users with more choices, the outer contour of the outer frame 220 can also be triangular, rectangular or any other desired geometric shape. In some embodiments (see FIG. 5), the outer frame 220 may also have at least one opening.

Figure 3:
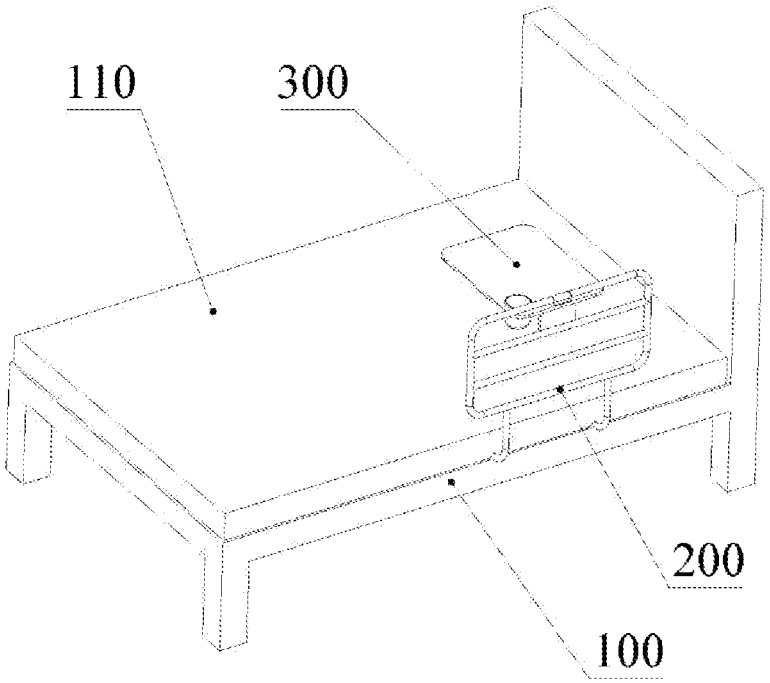
FIG. 3 is a schematic diagram of the bedside guardrail of the present invention installed on the bed body.

As shown in FIGS. 3 and 4, the fixed end 230 is configured to be detachably attached to the bed body 100. As a preferred embodiment of the present invention, the fixed end 230 extends from the lower edge of the outer frame 220 and has a bending part 231 with a bending angle of 90 degrees, and the fixed end 230 continues to extend through the bending part 231, so that the fixed end 230 has a long straight section 232 that remains basically vertical to the outer frame 220. The long straight section 232 is provided with a retaining device 233 to form a detachable connection with the bed body 100. In this embodiment, the connection mode is a fastening connection. Specifically, the bed 100 is provided with a fastening part. The retaining device 233 receives the fastening action of the fastening part and holds the fixed end 230 on the bed body 100. When the bedside guardrail needs to be detached from the bed 100, it is only necessary to unlock the fastening part from the holding device 233, and the detachment action can be completed. In this embodiment, the fastening part adopts a conventional fastening element. In some embodiments, the connection mode can also adopt threaded connection.

Figure 6:
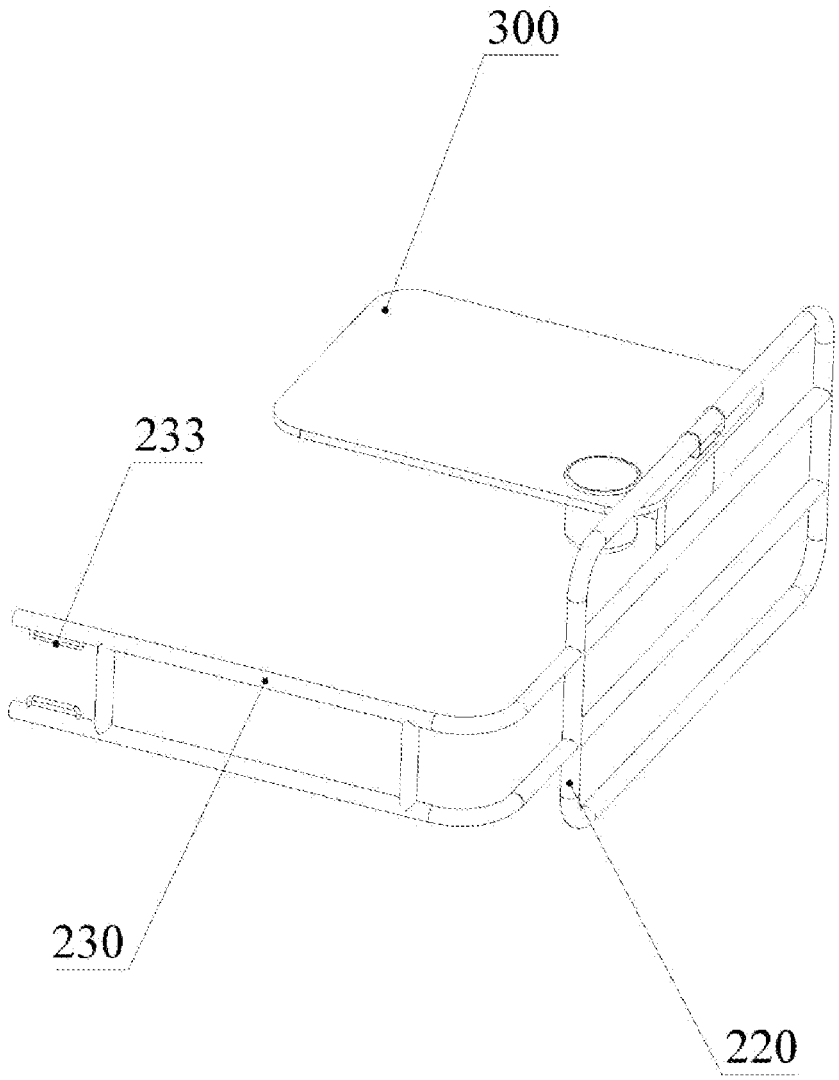
FIG. 6 is another schematic view of the guardrail.
Figure 7:
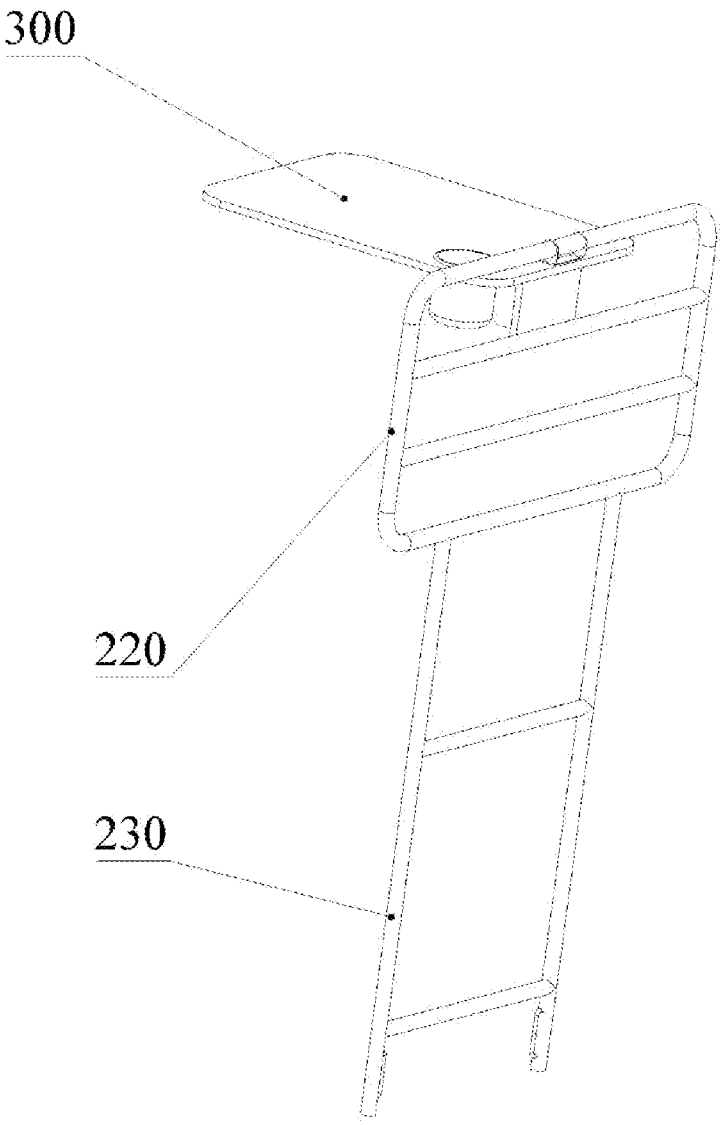
FIG. 7 is another schematic view of the guardrail.

In other embodiments (see FIG. 6), in order to be used in more scenes, the fixed end 230 can also extend from the side of the outer frame 220. In some embodiments (see FIG. 3), a mattress 110 can be directly pressed against the long straight section 232 of the fixed end 230, and the bedside guardrail can be fixed by the gravity of the mattress 110. In some embodiments (see FIG. 7), the fixed end 230 is not provided with a bending part 231, but directly extends out to form a long straight section 232, and is detachably attached to the bed body 100 through the long straight section 232. In the preferred embodiment of the present invention, the fixed end 230 is integrally formed with the outer frame 220, and in some embodiments, the fixed end 230 can also be assembled with the outer frame 220 through connectors.

Figure 8:
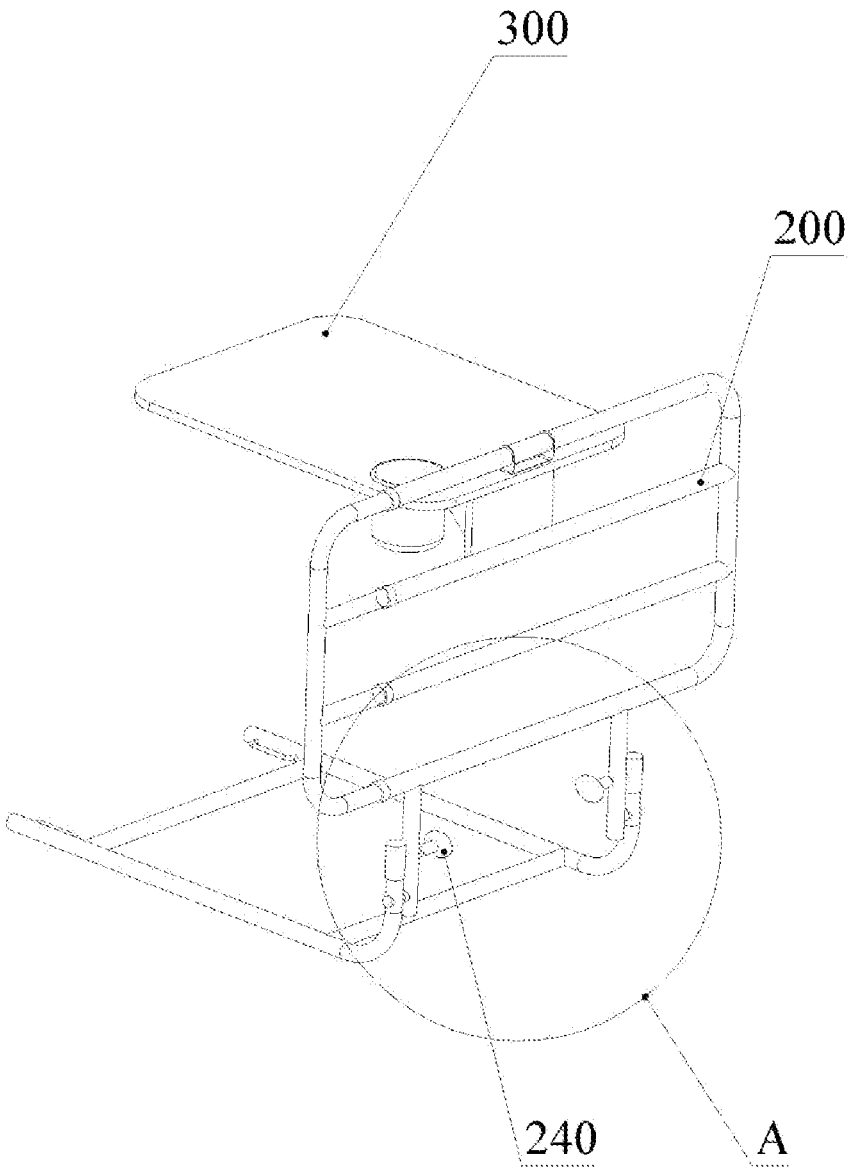
FIG. 8 is another schematic view of the guardrail.
Figure 9:
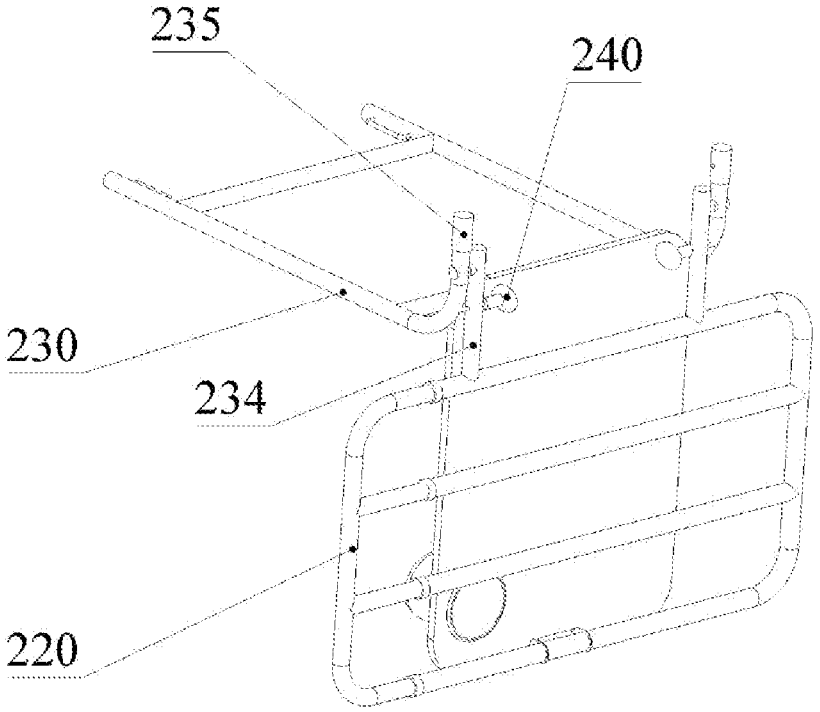
FIG. 9 is another schematic view of the guardrail.

In some embodiments, as shown in FIGS. 8 and 9, the outer frame 220 further includes a rotating mechanism 240, and the outer frame 220 can be switched between the blocking state and the opening state by using the rotating mechanism 240, so that the user can contact the blocking of the bedside guardrail on the bed body 100 without disassembling the bedside guardrail, and it is convenient for the nursing staff to replace the sheets or mattress 100.

Figure 10:
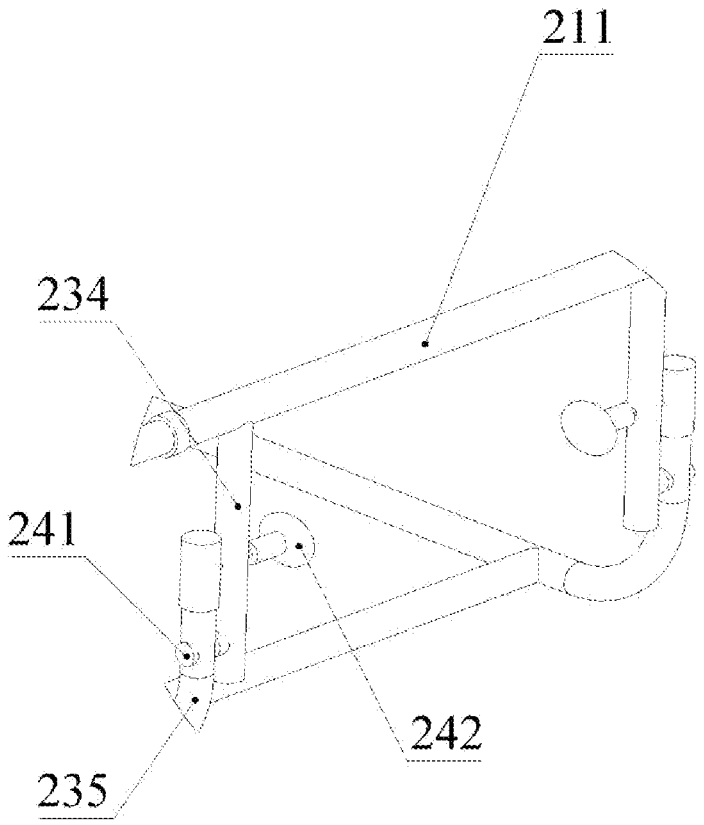
FIG. 10 is a schematic view at A in FIG. 8.
Figure 11:
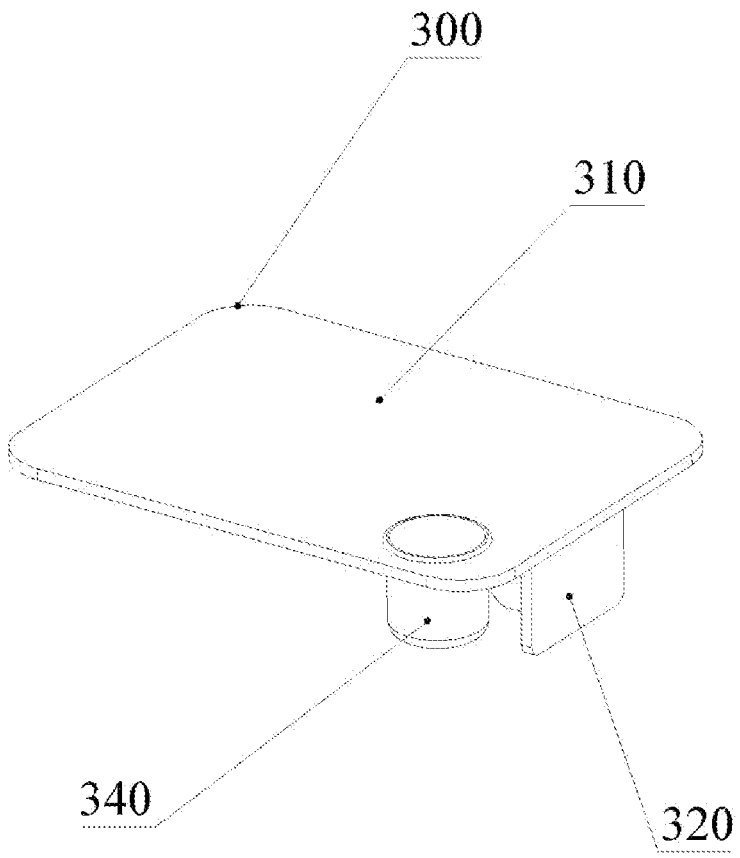
FIG. 11 is a schematic diagram of a table board.

Specifically, as shown in FIG. 10, the fixed end 230 includes an upper section 234 and a lower section 235, and the rotating mechanism 240 includes a rotating shaft 241 and a fixing pin 242. Both the upper section 234 and the lower section 235 are provided with a through hole for the rotating shaft 241 to pass through and a pin hole for the fixing pin 242 to insert, wherein the rotating shaft 241 is fixedly arranged in the through holes of the upper section 234 and the lower section 235 to connect the upper section 234 and the lower section 235. When the outer frame 220 needs to block the bed body 100, the fixing pin 242 is inserted into the pin holes of the upper section 234 and the lower section 235 to maintain the blocking state of the outer frame 220. When it needs to contact the blocking state, the fixing pin 242 can be pulled out, wherein the fixing pin 242 can be fixedly inserted into any pin hole of the upper section 234 or the lower section 235, or one end of the fixing pin 242 can be fixed with the outer frame 220 through a rope, which is convenient for users to use the fixing pin 242 quickly, and at the same time effectively prevents the loss of the fixing pin 242. In some embodiments (not shown in the figure), the upper section 234 and the lower section 235 may be additionally provided with a fixing hole to keep the outer frame 220 open relative to the bed body 100.

In some embodiments (not shown in the figure), the rotating mechanism 240 can also have other configurations, for example, the rotation of the outer frame 220 can have more adjustment angles through gears to meet other use requirements of users. In some embodiments (not shown in the figure), the rotating shaft 241 can also be configured as a damping shaft to reduce the wear during rotation and improve the service life.

In order to facilitate patients to have meals in bed, as shown in FIGS. 1, 4, 11 and 12, the bedside guardrail provided by the present invention further includes a table board 300, which includes a relatively flat table board surface 310 and a rotation restricting part 320 pivotally attached to the outer frame 220 to rotate between a first position and a second position around a first axis X, wherein the rotation restricting part 320 extends from the table board 300 along a direction opposite to the supporting direction of the table board surface 310.

As a preferred embodiment of the present invention, as shown in FIG. 1, FIG. 2 and FIG. 4, the upper horizontal pipe 221 of the outer frame 220 with a substantially rectangular shape defines a first axis X, and the table board 300 is pivotally attached to the upper horizontal pipe 221 to be rotationally switched between a first position in a use state and a second position in a storage state around the first axis X.

As shown in FIG. 1, when the table board 300 pivots around the first axis X and is in the first position, the rotation restricting part 320 ends on the blocking plane, and the table board surface 310 remains substantially parallel to the ground; when the table board 300 pivots around the first axis X and is in the second position, the supporting direction of the table board surface 310 faces away from the bed 100. Specifically, as shown in FIG. 4, the inner extension arm 210 extends from the outer frame 220 and on the blocking plane. When the table board 300 is in the first position, the rotation restricting part 320 abuts on the inner extension arm 210, which blocks the table board 300 and restricts the further rotation of the table board 300. At this time, the table board surface 310 remains basically parallel to the ground, which is convenient for users to eat on the table board 300.

Figure 13:
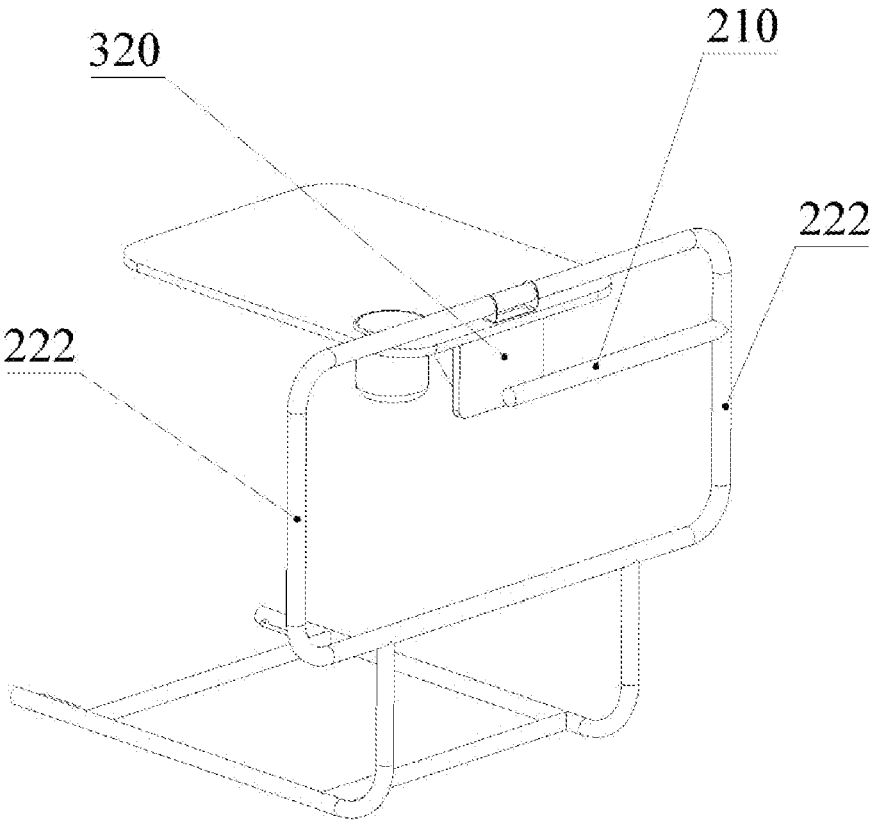
FIG. 13 is another schematic view of the inner extension arm.
Figure 14:
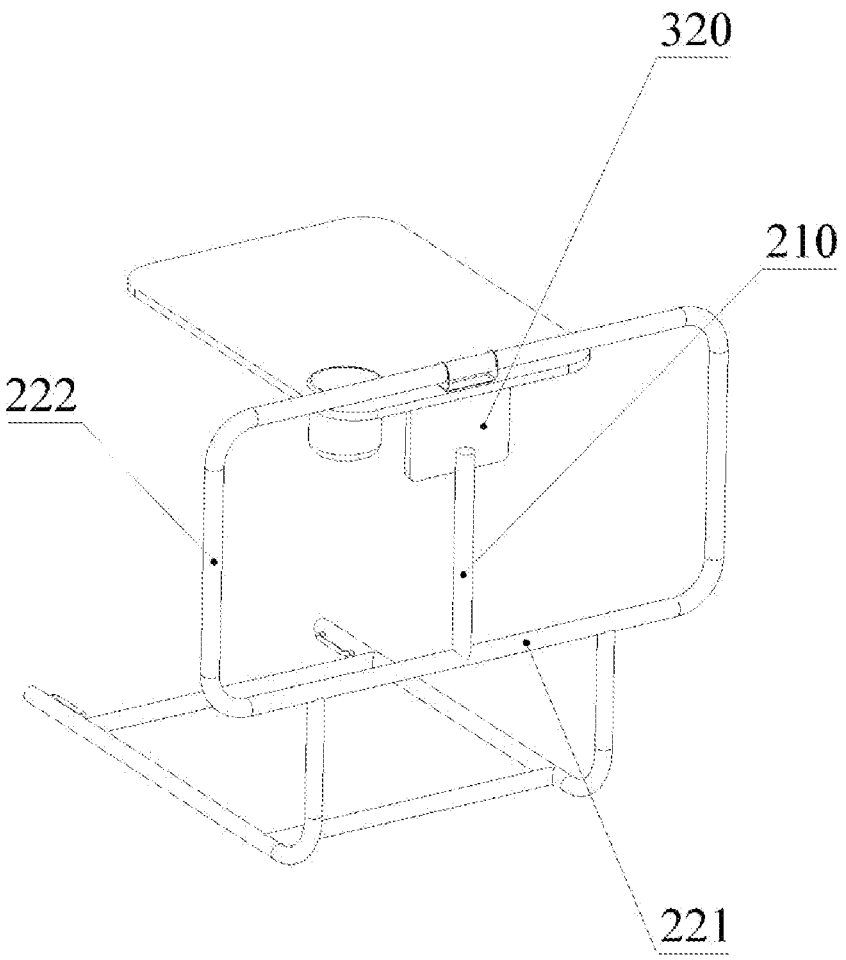
FIG. 14 is another schematic view of the inner extension arm.
Figure 15:
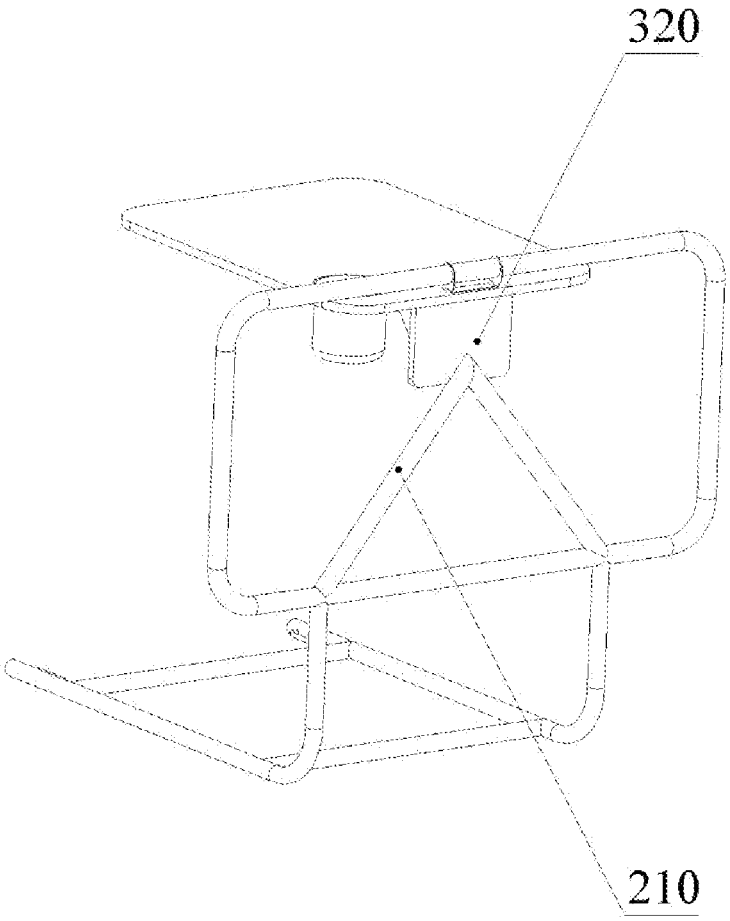
FIG. 15 is another schematic view of the inner extension arm.

In this embodiment, the inner extension arm 210 protrudes from the vertical pipe 222 of the outer frame 220 and extends on the blocking plane, and is finally connected with another vertical pipe 222, and its extension position is preferably configured such that when the rotation restricting part 320 approaches and reaches the blocking plane, the inner extension arm 210 can just abut against the rotation restricting part 320 and form a block. In some embodiments, the inner extension arm 210 can extend in other ways. As shown in FIG. 13, the inner extension arm 210 extends from the vertical pipe 222, but is not connected with another vertical pipe 222. As shown in FIG. 14, the inner extension arm 210 extends from the horizontal pipe 221, and its extension position can also abut against the rotation restricting part 320. As shown in FIG. 15, in order to meet the user's use requirements, the extension mode of the inner extension arm 210 can also have a shape, so that the outer frame 220 forms a stronger block to the bed body 100. In other embodiments, the inner extension arm 210 has any desired extension mode, as long as it can abut against and block the rotation restricting part 320.

Figure 12:
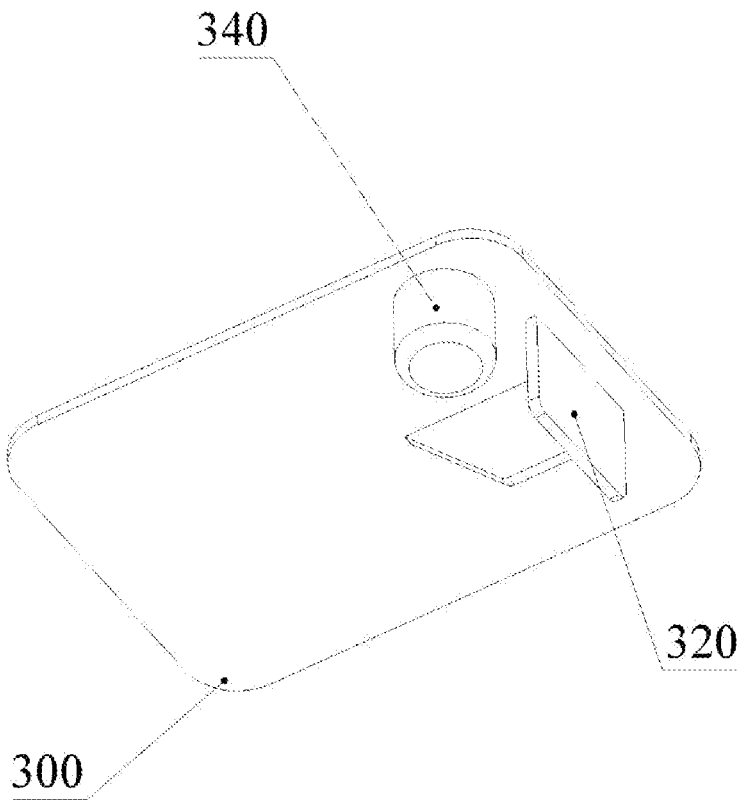
FIG. 12 is another schematic view of the table board.
Figure 16:
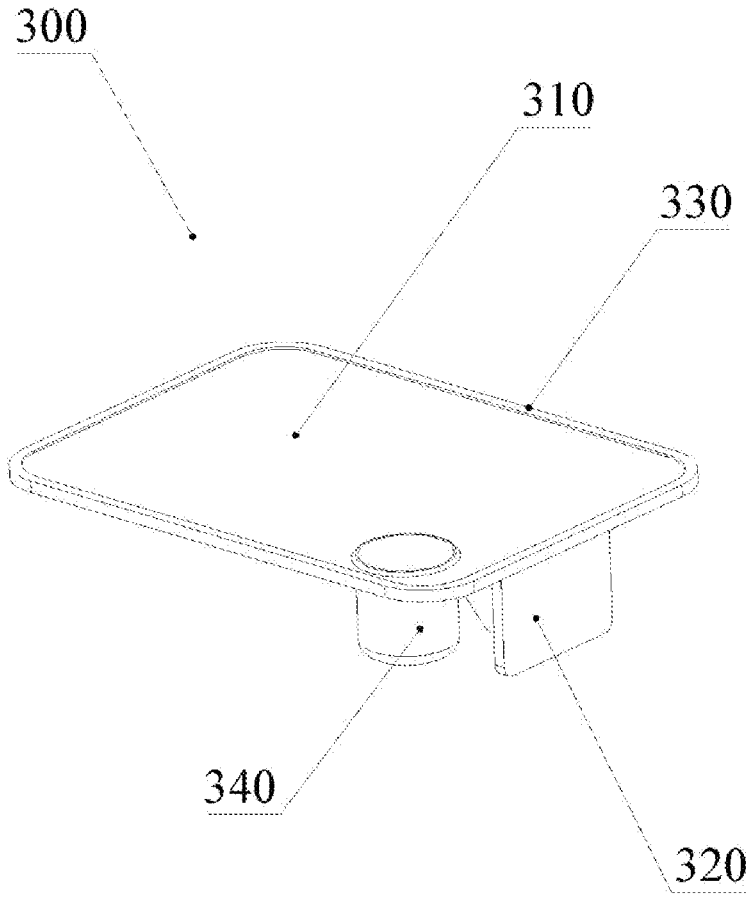
FIG. 16 is another schematic view of the table board.

In some embodiments, as shown in FIG. 16, in order to further facilitate the dining of users, the table board 300 further includes a retaining lip 330, which is continuously formed around the outer periphery of the table board 300 and protrudes upward along the supporting direction of the table board surface 310. As shown in FIG. 12, the table board 300 is also provided with a cup holder 340, which is convenient for users to place cups or other tableware.

In this embodiment, the retaining lip 330 has a height difference of 1 cm relative to the table board surface 310, so that the retaining lip 330 can effectively limit the tableware on the table board surface 310, prevent it from falling, and further facilitate the dining of users. In some embodiments (not shown in the figure), in order to further improve the restraining effect on tableware, the retaining lip 330 may have a higher restraining height. In some embodiments (not shown in the figure), in order to meet the user's use requirements, the retaining lip 330 formed continuously around the outer periphery of the table board 300 may have uneven protruding heights, and the retaining lip 330 has a roughly wavy shape. In some embodiments (not shown), in order to clean the table board surface 310 conveniently after eating, the retaining lip 330 can also be provided with an opening to provide a passage for dining stains left on the table board surface 310 to leave the table board surface 310. In some embodiments (not shown in the figure), the table board surface 310 is further provided with anti-slip lines to further limit the sliding of tableware on the table board surface 310.

Figure 17:
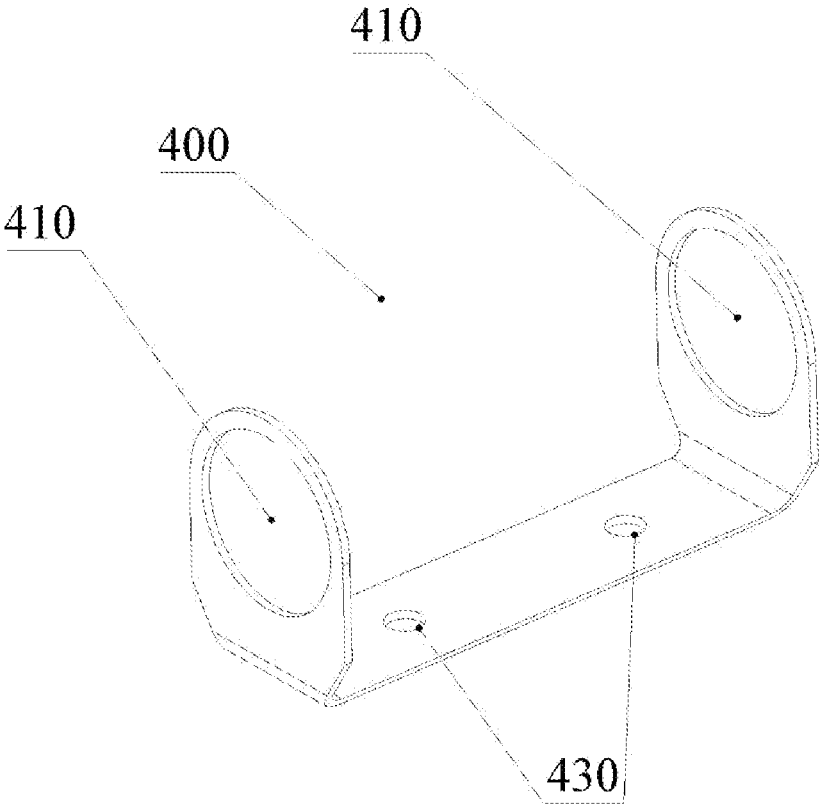
FIG. 17 is a schematic view of a pivot member.

As shown in FIGS. 1 and 17, the table board 300 of the present invention is attached to the outer frame 220 through a pivot member 400 to rotate between a first position and a second position around a first axis X. Specifically, the pivot member 400 has a central opening 410 that accommodates the outer frame 220, and the pivoting axis of the pivot member 400 coincides with the first axis X.

In this embodiment, the pivot member 400 penetrates the upper horizontal pipe 221 of the outer frame 220, and the pivot member 400 can slide back and forth on the upper horizontal pipe 221, so that the pivoting axis of the pivot member 400 coincides with the first axis X. The pivot member 400 is also provided with a threaded hole 430, which forms a detachable connection with the table board 300 in a threaded manner. When a user needs to replace the table board 300, the pivot member 400 can be connected through this connection. In some embodiments (not shown in the figure), the connection mode can also adopt fastening connection.

Figure 18:
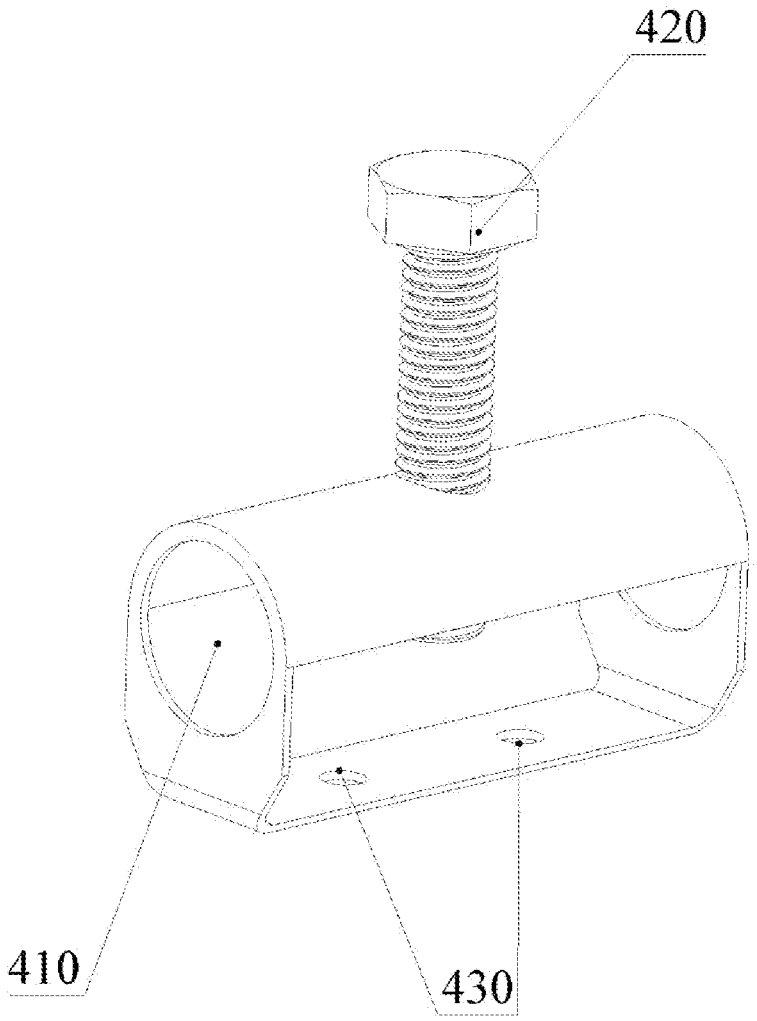
FIG. 18 is another schematic view of the pivot member.

In some embodiments, as shown in FIG. 18, the pivot member 400 is further provided with a fixing device 420, and the fixing device 420 forms a fastening connection with the outer frame 220 to keep the pivot member 400 on the outer frame 220. In this embodiment, the fixing device 420 is in the form of a screw. When it is necessary to keep the pivot member 400 in one position, the screw is butted against the outer frame 220, so that a fastening connection is formed between the screw and the outer frame 220. When it is necessary to adjust the position of the pivot member 400 and then adjust the horizontal position of the table board 300 relative to the outer frame 220, it is only necessary to loosen the screw. In some embodiments (not shown in the figure), the fixing device 420 may also take the form of a fastener, and the pivot member 400 is held and fixed on the outer frame 220 by the fastening of the fastener. In some embodiments (not shown in the figure), the fixing device 420 can also take the form of magnet attraction.

Figure 19:
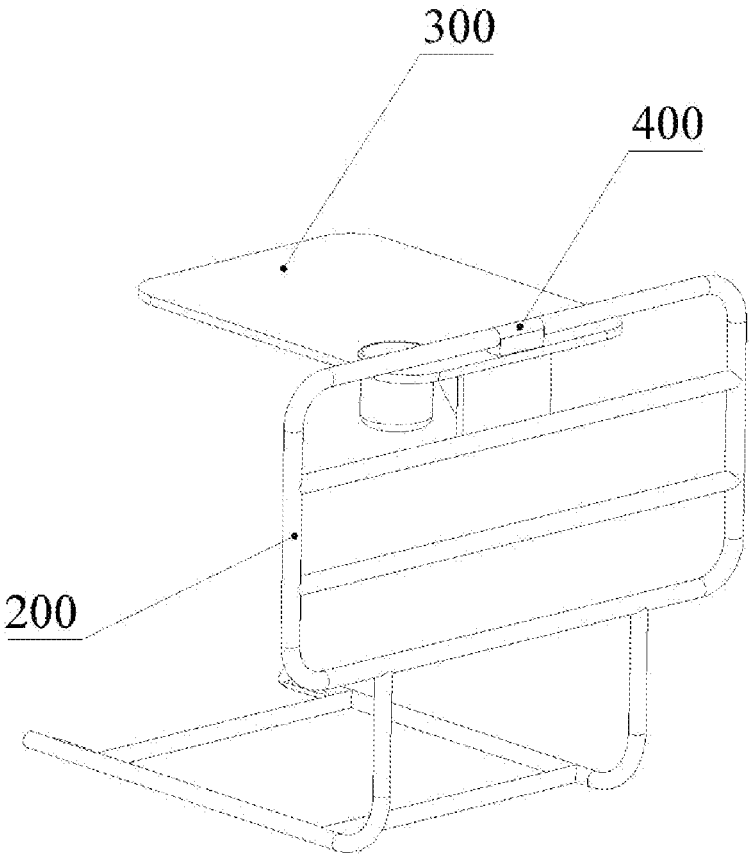
FIG. 19 is another schematic view of the pivot member.

In other embodiments, as shown in FIG. 19, the pivot member 400 has the same outer diameter as the horizontal pipe 221 of the outer frame 220. Specifically, the pivot member 400 is fixedly arranged on the horizontal pipe 221 without the central opening 411, and its pivoting axis is arranged in the horizontal pipe 221, so that the table board 300 can rotate more stably when switching between the first position and the second position by the pivot member 400.

Figure 20:
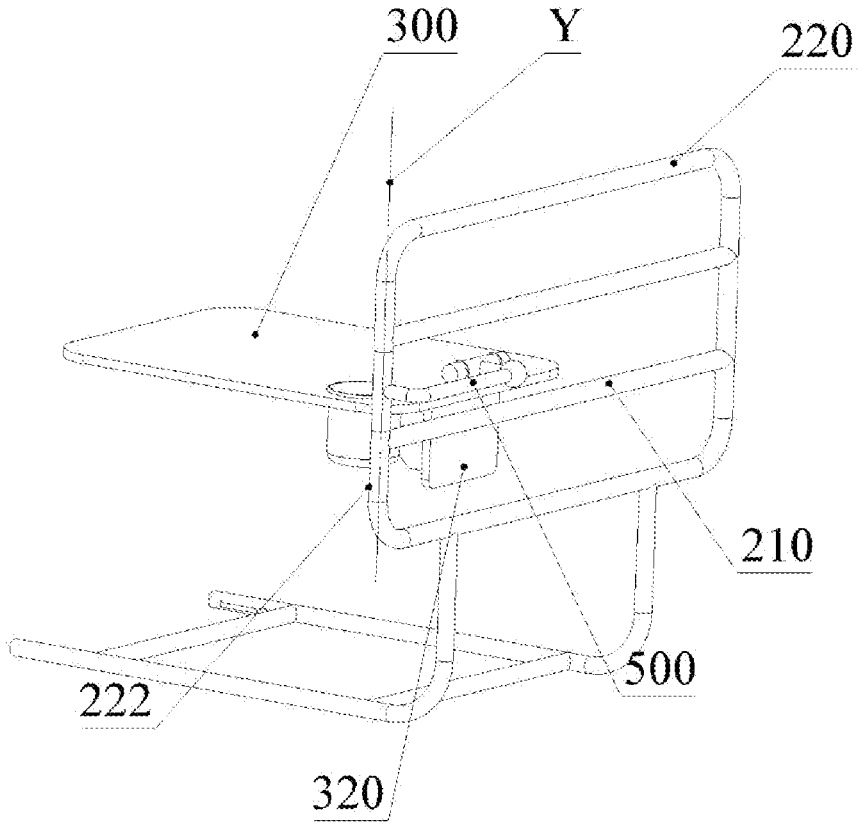
FIG. 20 is a schematic diagram of a table board in a first position according to another embodiment of the present invention.
Figure 21:
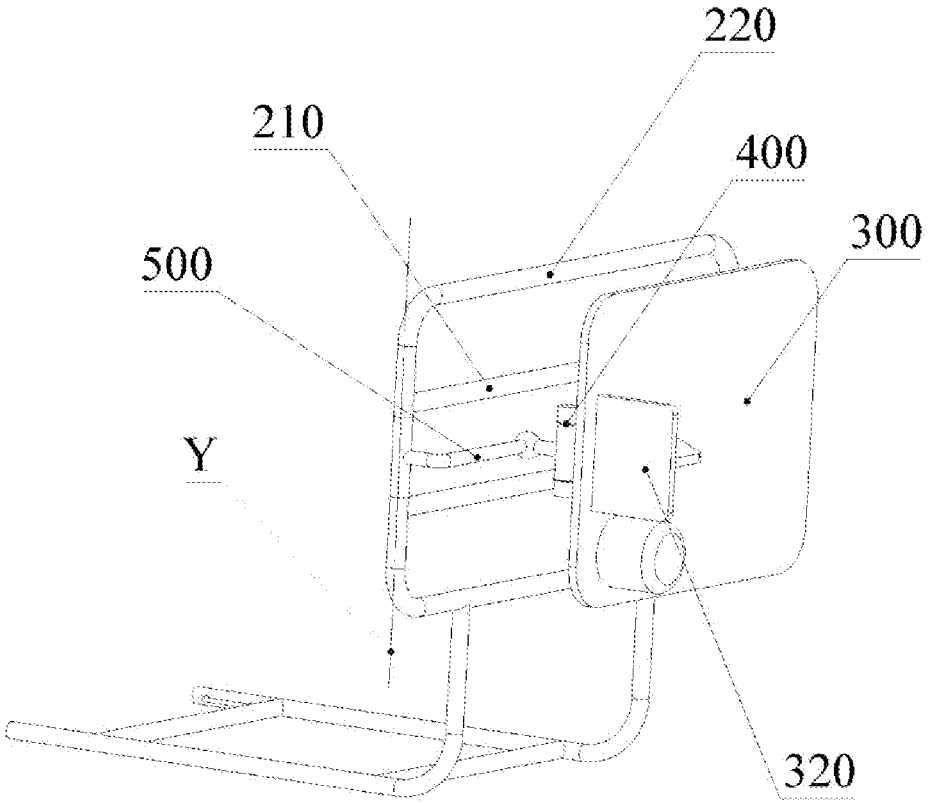
FIG. 21 is a schematic view of a table board in a second position according to another embodiment of the present invention.

In another embodiment of the present invention, as shown in FIGS. 20 and 21, the present invention simultaneously provides a bed rail with table, including a guardrail 200 and a table board 300, wherein the guardrail 200 is composed of an outer frame 220 with an inner extension arm 210 and a fixed end 230 that can be attached to the bed body 100, and the outer frame 220 defines a substantially flat blocking plane, and the inner extension arm 210 protrudes from the outer frame 220.

The table board 300 includes a relatively flat table board surface 310 and a rotation restricting part 320 pivotally attached to the outer frame 220 to rotate between a first position and a second position around the second axis Y, wherein the rotation restricting part 320 extends from the table board 300 in a direction substantially opposite to the supporting direction of the table board surface 310;

When the table board 300 pivots around the second axis Y and is in the first position, the rotation restricting part 320 ends on the blocking plane, and the table board surface 310 remains substantially parallel to the ground; when the table board 300 pivots around the second axis Y and is in the second position, the supporting direction of the table board surface 310 faces away from the bed 100.

In this embodiment, the vertical pipe 222 of the substantially rectangular outer frame 220 defines the second axis Y. The table board 300 rotates around the second axis Y and has a first position in a use state and a second position in a storage state.

In order to make the table board 300 switch between the first position and the second position around the second axis Y smoother and more stable, as shown in FIGS. 20 and 21, the present invention also provides a multi-axis rotating device 500. Specifically, one end of the multi-axis rotating device 500 is rotatably connected with the vertical pipe 222 of the outer frame 220, and the other end is detachably attached to the table board 300. In this embodiment, one end of the multi-axis rotating device 500 is configured to be received by the pivot member 400, and the table board 300 rotates around the second axis Y through the multi-axis rotating device 500 between the first position and the second position.

In this embodiment, the multi-axis rotating device 500 is preferably configured to have three rotational degrees of freedom, and in other embodiments, the multi-axis rotating device 500 may also have other numbers of rotational degrees of freedom.

The bedside guardrail with the folding table board provided by the present invention has a better protection and blocking function, can confine patients to the bed, and can be conveniently and quickly accommodated by nursing workers when the blocking function of the guardrail is not needed; in addition, the guardrail also has a dining table function, and can quickly provide a supporting platform when patients need to have meals in the bed; and meanwhile, the supporting platform is simple in structure and low in failure rate, which greatly facilitates the nursing work and the use of patients.

The technical means disclosed in the solution of the present invention are not limited to the technical means disclosed in the above embodiments, but also include the technical solution composed of any combination of the above technical features. It should be pointed out that for those skilled in the art, several improvements and embellishments can be made without departing from the principle of the present invention, and these improvements and embellishments are also regarded as the protection scope of the present invention.

What is claimed is:

1. A bed rail with table, comprising a guardrail and a table board, wherein, the guardrail consists of an outer frame with an inner extension arm and a fixed end that can be attached to a bed body, wherein the outer frame defines a substantially flat blocking plane, and the inner extension arm extends from the outer frame and extends on the blocking plane;

the table board comprises a relatively flat table board surface and a rotation restricting part pivotally attached to the outer frame to rotate between a first position and a second position around a first axis, wherein the rotation restricting part extends from the table board in a direction substantially opposite to a supporting direction of the table board surface;

when the table board pivots around the first axis and is in the first position, the rotation restricting part ends on the blocking plane, and the table board surface remains basically parallel to the ground; when the table board pivots around the first axis and is in the second position, the supporting direction of the table board surface faces away from the bed body.

2. The bed rail with table according to claim 1, wherein the first axis coincides with the blocking plane and extends in a direction parallel to a side edge of the bed body.

3. The bed rail with table according to claim 2, further comprising a pivot member, wherein the pivot member has a central opening for accommodating the outer frame, and a pivoting axis of the pivot member coincides with the first axis.

4. The bed rail with table according to claim 3, wherein the pivot member is detachably attached to the table board, and a fixing device is also arranged on the pivot member, and the fixing device forms a fastening connection with the outer frame to keep the pivot member on the outer frame.

5. The bed rail with table according to claim 1, wherein the fixed end is formed with a bending part and a long straight section, the bending part has a bending angle of 90 degrees, and the long straight section continuously extends from an end of the bending part and keeps basically vertical relative to the outer frame.

6. The bed rail with table according to claim 1, wherein the fixed end is provided with a retaining device, and the bedside guardrail is detachably attached to the bed body through the retaining device.

7. The bed rail with table according to claim 1, wherein the fixed end comprises an upper section and a lower section, wherein the upper section is connected with a lower edge of the outer frame, and the lower section is detachably attached to the bed body, and further comprises a rotating mechanism which rotatably connects the upper section and the lower section together, so that the outer frame has a blocking state and an opening state relative to the bed body.

8. The bed rail with table according to claim 1, wherein the table board further comprises a retaining lip which is continuously formed around an outer periphery of the table board and protrudes upward along the supporting direction of the table board surface.

9. The bed rail with table according to claim 1, further comprising a multi-axis rotating device, wherein one end of the multi-axis rotating device is rotatably connected with one end of the outer frame, and the other end is detachably attached to the table board, and the table board rotates between the first position and the second position around a second axis through the multi-axis rotating device.

* * * * *